United States Patent [19]

Isaac

[11] 4,254,971

[45] Mar. 10, 1981

[54] PRESSURE-SENSITIVE RECORD MATERIAL AND PREPARATION THEREOF

[75] Inventor: Peter A. H. Isaac, Summit, N.J.

[73] Assignee: Engelhard Minerals & Chemicals Corporation, Edison, N.J.

[21] Appl. No.: 46,811

[22] Filed: Jun. 8, 1979

[51] Int. Cl.[3] ..... B41M 5/22

[52] U.S. Cl. ..... 282/27.5; 427/150; 427/151; 427/152; 427/180; 428/307; 428/330; 428/914

[58] Field of Search ..... 106/21-23; 282/27.5; 427/150-152, 180; 427/307, 411, 537, 913, 914, 330

[56] References Cited

U.S. PATENT DOCUMENTS

| | | | |
|---|---|---|---|
| 3,063,864 | 11/1962 | Norman | 428/195 |
| 3,158,506 | 11/1964 | Ellison | 428/309 X |
| 3,287,154 | 11/1966 | Haas | 117/36.9 |
| 3,432,327 | 3/1969 | Kan et al. | 260/29.1 R |
| 3,454,344 | 7/1969 | Ryan et al. | 401/195 |
| 3,639,158 | 2/1972 | Maskal et al. | 428/539 X |
| 3,705,049 | 12/1972 | Busch | 117/36.9 |
| 4,113,282 | 9/1978 | Spatz et al. | 282/27.5 |

OTHER PUBLICATIONS

*Hackh's Chemical Dictionary,* 4th ed., McGraw-Hill Book Co., p. 26.

*Primary Examiner*—Bruce H. Hess
*Attorney, Agent, or Firm*—Inez L. Moselle

[57] ABSTRACT

Novel pressure-sensitive manifold record material comprises paper coated on one side with an encapsulated solution of an alkali-sensitive color precursor such as phenolphthalein in a polar solvent and coated on the reverse side or on a separate sheet of paper with particles of a white alkaline pigment such as fluid energy milled lime. The sheets are assembled for manifold record material by stacking sheet material coated with encapsulated dye solution in face-to-face relationship with surfaces coated with alkaline pigment. Upon rupture of the capsules by printing pressure, a colored mark is formed on the surface containing the alkaline pigment particles.

4 Claims, No Drawings

PRESSURE-SENSITIVE RECORD MATERIAL AND PREPARATION THEREOF

BACKGROUND OF THE INVENTION

1. Field of the Invention

This invention relates generally to so-called "carbonless copying paper." This is pressure-sensitive record sheet material of the type utilizing pressure-rupturable microcapsules of a solution of color-reactant dye precursor which produces a colored mark when placed in contact with pigment particles after a barrier normally separating the dye precursor and pigment particles is broken by printing pressure. More specifically, the instant invention relates to the use of such record material which utilizes encapsulated alkali-sensitive color precursors and alkaline pigments to develop the color of the dye precursor.

Pressure-sensitive record material based on the use of microencapsulated color precursors and reactive pigments is old in the art. Such record material is of two general types. In one the color precursor is an acid-sensitive material and it reacts with an acidic pigment or acidic resin to produce a colored species. An example is the record material which utilizes an encapsulated solution of crystal violet lactone mixed with benzoyl leucomethylene blue as the dye precursor and attapulgite clay or Japanese acid clay as the pigment. Another example of this type of record material employs crystal violet lactone and a phenolic resin mixed with kaolin clay. A second type of pressure-sensitive record material features the use of an encapsulated complexing agent which reacts with a metal-bearing coating to produce a colored metal complex.

Currently available pressure-sensitive record material leaves much to be desired. The pigments that are useful with acid-reacting dyes exemplified by crystal violet lactone are costly and the developed dyes tend to fade rapidly during use. Fading of the image is minimized somewhat by using a secondary dye precursor such as benzoyl leucomethylene blue. However, rapid fade of crystal violet lactone im ages is still a problem that awaits a practical solution. Furthermore, the pigments which are effective with acid-reacting dyes leave much to be desired in ease (hence cost) of coating. Print receiving sheets coated with acidic resin systems tend to yellow and develop an odor on storage. Further, the sheets do not produce printed images of strong intensity and the sheets tend to lose sensitivity on aging. On the other hand, record material based upon the use of a color precursor which is a complexing agent produces a printed image of weak intensity and undesirable hue.

PRIOR ART

Numerous patents and publications deal with record material of the type in which the color precursor is acid-sensitive and the pigment is an acidic material such as certain clay materials. An example is U.S. Pat. No. 2,730,456 to Green et al.

I am aware that alkaline reactive dye precursors have been used in dyeing textiles and that it has been suggested to use them as sensitizers in electrography (U.S. Pat. No. 3,476,559 to Panken) and as color formers in mechanical transfer papers (U.S. Pat. No. 3,595,683 to Newman). It has also been suggested to use alkaline reactive dye precursors in various recording material (U.S. Pat. No. 3,158,506 to Ellison and U.S. Pat. No. 3,063,864 to Norman); however, alkaline coating pigments are not employed to develop the color in these systems.

THE INVENTION

An object of the invention is to provide novel carbonless copying paper which overcomes defect of prior art pressure-sensitive record material.

A specific object of this invention is to provide pressure-sensitive record material which utilizes stable anionic dyes and inexpensive white pigments in place of prior art unstable dyes and relatively expensive off-white pigments used in conventional carbonless copying paper.

This invention results from my initial concept of utilizing stable anionic dyes in place of the unstable cationic dyes used in commercial carboness copying paper and the subsequent realization that since the stable anionic dyes where also acid-base indicators they could produce colored images when placed in contact with inexpensive white alkaline pigments.

Briefly stated, the present invention comprises novel pressure-sensitive record material which utilizes the reaction between white alkaline pigments and a solution in a polar solvent of a normally colorless or weakly colored stable aninic dye precursor which is an acid-base indictor. The solution of dye precursor is confined in pressure-rupturable microcapsules which are coated on a surface of paper. The alkaline pigment is coated on the reverse side of the paper coated with the encapsulated anionic dye precursor or the alkaline pigment may be coated on separate sheets of paper. When the coatings of encapsulated anionic dye recursor and alkaline pigment are brought into contact and upon application of printing pressure and rupture of the capsules, a visible color is formed on the sheet coated with particles of alkaline pigment.

A major advantage of the copying paper of the invention over prior art copying paper utilizing acidic pigments such as Japanese acid clay is that the raw material cost is lower. Suitable alkaline pigments are relatively inexpensive and a single dye at low concentration in cheap common solvents is suitable. Another important advantage is that the print receiving sheets containing alkaline pigments are brighter and they do not lose sensitivity when the sheets are aged before use. Also, the dyes useful with the alkaline pigments are permanent which is in contrast to dyes used with the acidic pigments. Still another advantage is that high solids coating compositions containing alkaline pigments can be easily coated on paper using conventional coating technology. It is well known that coating compositions containing acidic pigments cannot be mae up at high solids and cannot be easily coated on paper.

DETAILED DESCRIPTION

Color formers useful in practice of my invention are well known as acid-base indicators in analytical chemistry and as leather and textile dyes, and in biological staining. See E. Gurr, "SYNTHETIC DYES IN BIOLOGY, MEDICINE AND CHEMISTRY", Academic Press, New York, 1971. Exemplary of useful materials are phenolophthalein, bromothymol blue, bromocresol green and eriochrome black T. Compounds of this class are characterized by the fact that they form colored anionic species, frequently blue or purple. However, other colors may be produced by appropriate selection of alkali-sensitive color precursors. The precursors are readily soluble in polar solvents such as alcohols, e.g., methanol, or glycols such as diethylene glycol. The resulting solutions possess little color until capsules containing the solutions are ruptured by printing pressure and come into contact with a surface coated with particles of alkaline pigments.

Alkaline pigments useful in practice of the invention include natural and synthetic alkaline earth carbnoates (calcium carbonate, magnesium carbonate, barium carbonate), alkaline earth oxides (magnesium oxide and calcium oxide), alumina and satin white. Also useful are alkaline earth hydroxide pigments such as calcium hydroxide and magnesium hydroxides. An especially useful alkaline earth hydroxide pigment is an expanded magnesium hydroxide pigment containing about 1 to about 5 weight percent calcium concentration in solid solution, as described in U.S. Pat. No. 3,639,158 to Maskal et al.

The alkaline pigments should be in the form of a powder. Generally, all or substantially all of the particles should be finer than about 10 microns (as determined by conventional sedimentation method). Typically from 50% to 100% by weight of the pigment particles are 2 microns or finer in size.

Mixtures of two or more of the aforementioned alkaline pigments may be used together as the sole pigment for coating print receiving sheets. It is within the scope of the invention to blend the alkaline pigment or mixture of alkaline pigments with conventional non-alkaline paper coating pigments, especially kaolin clay. The alkaline pigment must constitute a sufficient proportion of total pigment to produce a continuous printed imge on a pigment-coated receiving sheet. For example, the alkaline pigment or mixture of alkaline pigments may be blended with up to 50% by weight of a coating grade of kaolin clay.

To prepare sensitized coated print-receiving sheets, the pigment is prepared into an aqueous coating composition using conventional techniques for producing alkaline coated sheets as described, for example, in U.S. Pat. No. 3,369,158 (supra). The coating compositions contain a pigment, water, at least one binder material and usually a pigment dispersant. Useful compositions generally contain from about 10 to 25 parts by weight of binder per 100 parts by weight of pigment. Pigment binders are well-known in the art and serve to bind the pigment particles together and to the paper substrate. Examples are starches of various types, casein, polyvinyl alcohol, styrene-butadiene latex and synthetic polymeric resin emulsions such as the neutral emulsions of resins derived from acrylic and vinyl acetates. Pigment dispersing agents include sodium polyphosphates, sodium silicates, sodium acrylates and mixtures thereof. The coating compositions should have a pH of at least 6, and more preferably should be neutral or alkaline. Typical pH values of the coating compositions are in the rane 8 to 10. Ammonium or sodium hydroxide may be used to adjust the pH of the coating composition when necessary. Typical solids concentrations of the coating compositions are in the range of 30 to 69 percent by weight.

Conventional methods can be used to apply the alkaline pigmented coating compositions to paper. Blade or roll coaters using machine coating or off-machine coating may be used. Coat weights within the range of 4.5 to 10 g./m$^2$ are recommended.

Suitable methods for forming polymeric microcapsules containing solutions of dye precursors in polar solvents are known in the art. Incorporated herein by reference is the applicable disclosure of U.S. Pat. No. 3,173,878 to Reyes. Briefly, a precursor of the dye material is dissolved in a polar solvent, suitably a mixture of methanol and water, and the solution is dispersed as colloidal droplets in a hydrophobic encapsulating polymer in a nonaqueous nonpolar liquid solvent. To this dispersion there is added a nonaqueous polar liquid that is miscible with the polymer solution but is not a solvent for the polymer. This results in precipitation of the polymer around the droplets of dye precursor in the polar solvent. The microcapsules are separated from the liquid phase and insolubilized by washing with a mixture of solvent and nonsolvent for the polymer. The hardened microcapsules are separated from the wash mixture by filtration and coated on paper of a grade suitable for pressure-sensitive record material.

To make up manifold record material on-machine, the wire side of raw stock may be coated with a composition containing alkaline pigment and subsequently a coating of microencapsulated dye slurry may be applied to the felt side. To assemble the sheets for manifold printing, they are stacked in a manner such that the pigment coated surface of one sheet is in face-to-face relationship with a coating of rupturable microcapsules containing printing fluid on another sheet.

The following examples are given for illustrative purposes are not to be construed as limiting the invention to the particular embodiments described therein.

EXAMPLE I

A dye transfer sheet is prepared as follows: 0.05 parts of bromocresol green is dissolved in 80 parts of methyl alcohol and 20 parts of water to give a faintly orange solution. This solution is microencapsulated according to the method described in Example I of U.S. Pat. No. 3,173,878 to Reyes. The microcapsules are then coated on a paper sheet in an aqueous slurry by the procedure described in U.S. Pat. No. 3,625,736 to Marsukawa et al. The acceptor sheet is prepared by coating a paper sheet with a mixture of the following composition:

| | Parts |
|---|---|
| Fluid energy milled (hydratable) calcium oxide | 50.0 |
| Dispex ®* N40 (40% solids) | 1.25 |
| Dow 620** latex (50% solids) | 11.1 |
| Water | 37.65 |

*sodium polyacrylate
**styrene-butadiene

The Dispex is dissolved in the water and the calcium oxide is added with stirring. The latex is then mixed in to produce a coating color of low viscosity at 50% solids. The mixture is coated on a paper sheet to a coat weight of 8 g./m$^2$ and dried. The resulting pigment coated sheet is appreciably whiter and brighter than sheets coated with acidic pigments of the type used in commercial pressure-sensitive record material.

When the donor and acceptor sheets are placed in contact and the microcapsules broken by means of printing pressure, a deep blue mark is formed on the receptor sheet. The marks so formed will have good resistance to fading in light or in the dark and the sheets will not appreciably lose their activity on storage.

EXAMPLE II

An expanded magnesium hydroxide pigment is prepared by the oxychloride method described in U.S. Pat. No. 3,639,158. This pigment is mixed in amount of 40 parts by weight with 25 parts by weight of precipitated calcium carbonate and 35 parts by weight of a No. 1 grade kaolin coating clay. The pigment mixture is dispersed in water using Dispex 40 as a dispersant and is formed into a coating composition with 15 parts by weight styrene-butadiene latex per 100 parts by weight of pigment. The coating is applied to bleached paper to a coat weight of about 8 g./m$^2$. This paper is used to print with sheets coated with encapsulated solution of anionic dye precursor such as those described in the previous example.

I claim:

1. As a new article of manufacture, pressure sensitive record material comprising paper coated on one surface with a white coating of particles of a finely divided alkaline pigment, said pigment being a compound of an alkaline earth, and coated on the reverse side or on the surface of a different sheet of paper with pressure-rupturable capsules containing a solution in a polar solvent of an acid-base indicator which forms a colored anionic species when placed in contact with said particles of alkaline pigment.

2. The article of claim 1 wherein the solution of acid-base indicator in the capsules is at a pH at which the indicator is in substantially uncolored state and said indicator is selected from the group consisting of phenolphthalein, bromothymol blue, bromocresol green and eriochrome black T and mixtures thereof.

3. The article of claim 1 wherein the alkaline pigment is selected from the group consisting of alkaline earth carbonate, alkaline earth oxide, alkaline earth hydroxide, satin white and mixtures thereof.

4. As a new article of manufacture, pressure-sensitive record material coated on one side with a white coating consisting essentially of particles of a finely divided alkaline pigment selected from the group consisting of alkaline earth carbonate, alkaline earth oxide, alkaline earth hydroxide, satin white, alumina and mixtures thereof, and a neutral pigment binder, and coated on the reverse side with a multiplicity of pressure-rupturable capsules of a solution in a polar solvent of an acid base indicator at a pH at which the indicator is in substantially uncolored state, said indicator being selected from the group consisting of phenolphthalein, bromothymol blue, bromocresol green, eriochrome black T and mixtures thereof.

* * * * *